US009206583B2

(12) United States Patent
Beschorner et al.

(10) Patent No.: US 9,206,583 B2
(45) Date of Patent: Dec. 8, 2015

(54) VOID PROTECTION SYSTEM

(71) Applicant: Caterpillar Global Mining LLC, Oak Creek, WI (US)

(72) Inventors: Matthew J. Beschorner, Plainfield, IL (US); Bryan A. Johnson, Montgomery, IL (US); Brett J. Janson, Hanna City, IL (US); Brandon Z. Barnes, Oak Creek, WI (US); Rustu Cesur, Lombard, IL (US)

(73) Assignee: Caterpillar Global Mining LLC, Oak Creek, WI (US)

( * ) Notice: Subject to any disclaimer, the term of this patent is extended or adjusted under 35 U.S.C. 154(b) by 139 days.

(21) Appl. No.: 13/860,281

(22) Filed: Apr. 10, 2013

(65) Prior Publication Data

US 2014/0308106 A1 Oct. 16, 2014

(51) Int. Cl.

| | |
|---|---|
| ***E02F 3/42*** | (2006.01) |
| ***E02F 3/30*** | (2006.01) |
| ***E02F 3/46*** | (2006.01) |
| ***E02F 9/22*** | (2006.01) |
| ***F15B 21/04*** | (2006.01) |

(52) U.S. Cl.

CPC . *E02F 3/46* (2013.01); *E02F 9/226* (2013.01); *E02F 9/2207* (2013.01); *E02F 9/2217* (2013.01); *E02F 9/2267* (2013.01); *E02F 9/2292* (2013.01); *F15B 21/047* (2013.01); *F15B 2211/3058* (2013.01); *F15B 2211/30565* (2013.01); *F15B 2211/30575* (2013.01); *F15B 2211/6313* (2013.01); *F15B 2211/6346* (2013.01); *F15B 2211/7053* (2013.01); *F15B 2211/8609* (2013.01); *Y10T 137/87917* (2015.04)

(58) Field of Classification Search

CPC ..... E02F 3/425; E02F 3/30
USPC ..... 701/50; 414/685, 726; 91/45, 48, 418, 91/452; 60/368, 473; 137/613

See application file for complete search history.

(56) References Cited

U.S. PATENT DOCUMENTS

| | | | | |
|---|---|---|---|---|
| 5,960,695 | A | 10/1999 | Aardema et al. | |
| 6,216,456 | B1 * | 4/2001 | Mitchell | 60/452 |
| 6,378,301 | B2 * | 4/2002 | Endo et al. | 60/414 |
| 6,619,183 | B2 | 9/2003 | Yoshino | |
| 7,121,189 | B2 * | 10/2006 | Vonderwell et al. | 91/529 |
| 7,194,856 | B2 | 3/2007 | Ma et al. | |
| 7,204,084 | B2 * | 4/2007 | Ma et al. | 60/422 |
| 7,204,185 | B2 * | 4/2007 | Ma et al. | 91/446 |
| 7,243,493 | B2 * | 7/2007 | Ma et al. | 60/450 |
| 7,302,797 | B2 * | 12/2007 | Zhang et al. | 60/422 |
| 7,320,216 | B2 * | 1/2008 | VerKuilen et al. | 60/421 |

(Continued)

*Primary Examiner* — James Trammell
*Assistant Examiner* — Majdi Alsomiri
(74) *Attorney, Agent, or Firm* — Foley & Lardner LLP

(57) ABSTRACT

A void protection system for a mining shovel having an operator input device includes an independent metering valve assembly including one or more fluid source-cylinder valves for fluidly connecting the fluid source to the hydraulic cylinder. The system also includes a sensor assembly for monitoring the fluid pressure within the rod end and the head end of the hydraulic cylinder, and a control module. The control module is configured to monitor movement of the operator input device, monitor pressure within the hydraulic cylinder, increase the opening of the corresponding fluid source-cylinder valve and increase fluid flow from the fluid source to fill corresponding end of the hydraulic cylinder until pressure in the corresponding end of the hydraulic cylinder is above a first threshold pressure.

14 Claims, 14 Drawing Sheets

(56) References Cited

U.S. PATENT DOCUMENTS

| | | | | |
|---|---|---|---|---|
| 7,331,175 | B2 * | 2/2008 | VerKuilen et al. | 60/429 |
| 7,441,404 | B2 * | 10/2008 | Devier et al. | 60/368 |
| 7,634,911 | B2 * | 12/2009 | Brinkman | 60/414 |
| 7,823,379 | B2 * | 11/2010 | Hamkins et al. | 60/414 |
| 7,905,088 | B2 * | 3/2011 | Stephenson et al. | 60/418 |
| 2003/0041728 | A1 | 3/2003 | Lunzman et al. | |
| 2003/0106315 | A1 | 6/2003 | Smith | |
| 2004/0060430 | A1 * | 4/2004 | Brinkman | 91/361 |
| 2005/0087065 | A1 | 4/2005 | Yoshino | |
| 2006/0218912 | A1 * | 10/2006 | Price et al. | 60/459 |
| 2006/0266027 | A1 * | 11/2006 | Ma et al. | 60/469 |
| 2007/0044465 | A1 * | 3/2007 | Zhang et al. | 60/459 |
| 2007/0044649 | A1 * | 3/2007 | Smith et al. | 91/418 |
| 2008/0053191 | A1 * | 3/2008 | Yoo et al. | 73/1.72 |
| 2009/0032746 | A1 * | 2/2009 | Smith et al. | 251/30.02 |

* cited by examiner

VOID PROTECTION SYSTEM

TECHNICAL FIELD

This disclosure relates to mining vehicles, such as mining shovels or excavators, and particularly to void protection systems for such mining vehicles.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Mining shovels are often powered by hydraulic pressure systems. In these systems, hydraulic fluid is transmitted throughout the machine to various actuators, or hydraulic cylinders, where the fluid is converted into energy for powering the machine's components as necessary. For instance, the dipper assembly may be powered by one or more actuators. Typically, an operator will provide a command to the actuator via a control system, retracting or extending the cylinder in order to move the dipper assembly. The actuators may be used to apply a crowding force into a bank of material, filling the dipper with material.

When the dipper is filled with material, the dipper assembly may move without an operator command due to the weight of the dipper load, inadvertently extending or retracting the cylinder. When this occurs, a chamber of the cylinder may expand, creating a void in the cylinder. When the dipper assembly is moved by operator command, a source of fluid may be manually or automatically provided to fill the void and prevent cavitation. However, during a static condition (i.e. when the dipper assembly moves without an operator command), fluid is not typically provided without an operator command to fill the void, often leading to a cavitation within the cylinder. Cavitation within a hydraulic system can cause unwanted noise, damage to the hydraulic components, vibrations, a loss of efficiency, and can reduce the useful life of the system and its components.

Conventional mining shovels may include an independent metering valve for controlling the flow of hydraulic fluid from a pump to a hydraulic cylinder. An example of such a conventional independent metering valve can be found in U.S. Pat. No. 5,960,695 issued Oct. 5, 1999, for "System and Method for Controlling an Independent Metering Valve," which discloses an independent metering valve that includes four independently operable, electronically controlled metering valves to control fluid flow between a pump and hydraulic cylinder. This conventional independent metering valve is not controlled to automatically respond to void conditions with the hydraulic cylinder, and the associated cylinder is susceptible to voiding and/or cavitation when no operator command is given.

SUMMARY

An embodiment of the present disclosure relates to a mining shovel. The mining shovel includes a boom assembly, a hydraulic cylinder having a rod end and a head end, a dipper coupled to the hydraulic cylinder such that movement of the hydraulic cylinder moves the dipper, and an independent metering valve assembly coupled to the hydraulic cylinder and to a fluid source. The independent metering valve assembly includes one or more fluid source-cylinder valves for fluidly connecting the fluid source to the hydraulic cylinder.

In this embodiment, the mining shovel further includes an operator input device, a sensor assembly for monitoring the fluid pressure within the rod end and the head end of the hydraulic cylinder, and a control module. The control module is configured to monitor movement of the operator input device, when there is no movement at the operator input device, monitor pressure within the head end and the rod end of the hydraulic cylinder by receiving signals from the sensor assembly, when pressure in the rod end or the head end of the hydraulic cylinder decreases below a first threshold pressure, increase opening of the corresponding fluid source-cylinder valve and increase fluid flow from the fluid source to fill the corresponding end of the hydraulic cylinder until pressure in the corresponding end is above a second threshold pressure, and when pressure in the rod end or the head end of the hydraulic cylinder increases beyond the second threshold pressure, reduce opening of corresponding fluid source-cylinder valve and decrease fluid flow from the fluid source.

Another embodiment of the present disclosure relates to a void protection system for a mining shovel having an operator input device. The void protection system includes an independent metering valve assembly configured to couple to a fluid source and to a hydraulic cylinder having a rod end and a head end. The independent metering valve assembly includes one or more fluid source-cylinder valves for fluidly connecting the fluid source to the hydraulic cylinder. The void protection system also includes a sensor assembly for monitoring the fluid pressure within the rod end and the head end of the hydraulic cylinder, and a control module.

In this embodiment, the control module is configured to monitor movement of the operator input device, when there is no movement at the operator input device, monitor pressure within the head end and the rod end of the hydraulic cylinder by receiving signals from the sensor assembly, when pressure in the rod end or the head end of the hydraulic cylinder decreases below a first threshold pressure, increase opening of corresponding fluid source-cylinder valve and increase fluid flow from the fluid source to fill corresponding end of the hydraulic cylinder until pressure in the corresponding end of the hydraulic cylinder is above the first threshold pressure, and when pressure in the rod end or the head end of the hydraulic cylinder increases beyond a second threshold pressure, reduce opening of corresponding fluid source-cylinder valve and decrease fluid flow from the fluid source.

Another embodiment of the present disclosure relates to an independent metering valve assembly for a hydraulic system. The independent metering valve assembly includes a first fluid path for fluidly connecting a fluid source to a rod end of a hydraulic cylinder, a first valve coupled to the first fluid path and configured to controllably block the first fluid path, a second fluid path for fluidly connecting a fluid source to a head end of the hydraulic cylinder, and a second valve coupled to the second fluid path and configured to controllably block the second fluid path. The first and second valves are configured to controllably open when the fluid pressure within the corresponding end decreases below a first fluid pressure threshold, and wherein the first and second valves are configured to controllably close when the fluid pressure within the corresponding end increases above a second fluid pressure threshold.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
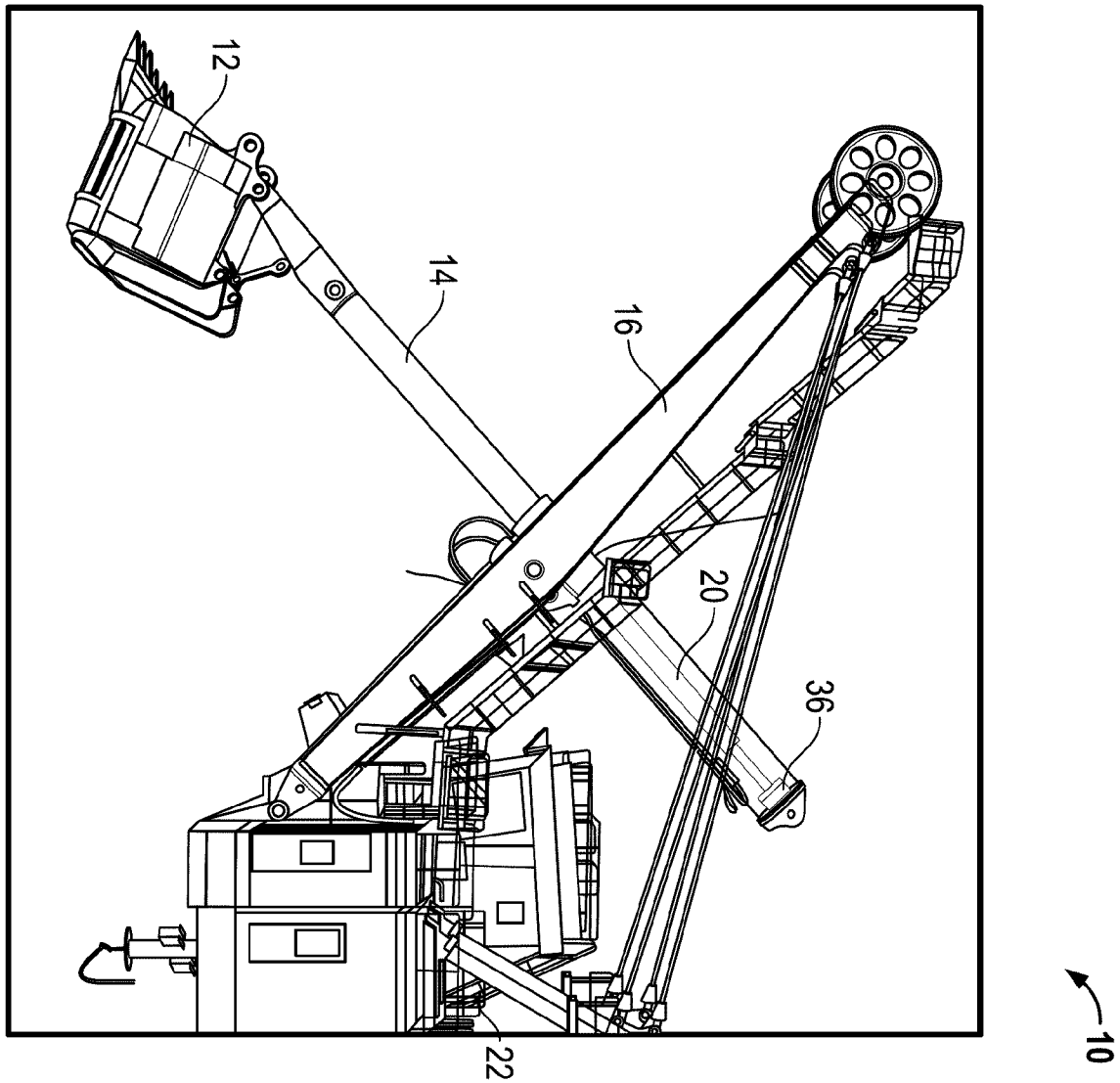
FIG. 1 is a side view of a mining shovel, according to an exemplary embodiment.

Referring now to FIG. 1, a mining shovel 10 is shown, according to an exemplary embodiment. The mining shovel 10 includes a dipper arm 14 and a dipper 12 supported by the boom assembly 16. Although the disclosure is shown and described by way of example with reference to a mining shovel 10, the disclosure is also applicable for use with any vehicle or device that uses a hydraulic cylinder (e.g. cylinder 20, etc.) to leverage a dipper or bucket, such as excavators, etc., all of which are intended to be within the scope of this disclosure.

The dipper arm 14 is pivotably coupled to the boom assembly 16, and configured to rotate relative to the boom assembly 16. The dipper 12 is coupled to the dipper arm 14, and operable to move in more than one direction along with the dipper arm 14. The dipper 12 is configured to hold earth and other materials that are loaded into the dipper 12 by the action of the dipper arm 14. The dipper arm 14 includes a hydraulic cylinder 20 used to apply a force to (i.e. move) the dipper 12, pushing the dipper 12 into a surface (i.e. a bank of material such as overburden, ore, or other material to be mined or moved and referred to collectively as "mining material") and filling the dipper 12 with mining material (e.g. earth, fragmented rock, etc.).

Typically, the dipper arm 14 and dipper 12 move in response to a signal received from an operator input device 22 located on the mining shovel 10. An operator may provide an input by pressing a button, moving a joystick, or otherwise interacting with the operator input device 22. In an exemplary embodiment, the operator input device 22 is coupled to a control module 32, and the control module 32 is coupled to one or more components within the mining shovel 10. The control module 32 receives inputs from the operator input device 22 and the control module 32 may provide a response. When the control module 32 receives an input from the operator input device 22, the control module 32 may cause actuator 24 within the hydraulic cylinder 20 to retract or extend, creating a void (i.e. a fluid pressure drop as a result of an expansion of volume) at a rod end 26 or head end 28 of the cylinder 20 (shown and described further with reference to FIGS. 3-8). In an exemplary embodiment, when the actuator 24 is moved in response to an input from the operator input device 22, the control module 32 causes a fluid source shown as hydraulic pump 30 to send pressurized fluid into the hydraulic cylinder 20, filling the void and preventing cavitation within the cylinder 20.

The mining shovel 10 also includes a void protection system 40 that, among other control features, is intended to prevent voiding and/or cavitation within the hydraulic cylinder 20. In some instances, the actuator 24 may extend or retract without input from the operator input device 22. For example, when the dipper 12 is filled with mining material, and the boom assembly 16 is above or below horizontal relative to the ground surface, the actuator 24 may retract or extend inadvertently. When the actuator 24 retracts or extends, a void may be created at the rod end 26 or the head end 28 of the cylinder 20. In these instances, the control module 32 does not receive an input from the operator input device 22 to fill the cylinder 20 with fluid, so the void protection system 40 monitors the cylinder 20 to provide hydraulic fluid as necessary.

The void protection system 40 includes a sensor assembly shown as sensors 34 for monitoring the fluid pressure within the rod end 26 and the head end 28 of the hydraulic cylinder 20. In an exemplary embodiment, the sensors 34 are located at or near the rod end 26 and the head end 28 of the hydraulic cylinder 20. The sensors 34 may also be mounted within work ports of one or more valves (e.g. valve 58, valve 60, etc.) within the system 40, within ports of the hydraulic cylinder 20, or at or near the hydraulic pump 30. In some embodiments, the void protection system 40 includes a single sensor 34 for monitoring the fluid pressure of the rod end 26 and the head end 28.

The sensors 34 of the void protection system 40 may include pressure sensors, displacement sensors, or another type of sensor configured to detect a void within the hydraulic cylinder 20. For instance, the sensors 34 may monitor a fluid pressure, displacement of the cylinder 20, the motion of the cylinder 20, and/or the velocity of the cylinder 20 in order to detect a void within the hydraulic cylinder 20. In an exemplary embodiment, the sensors 34 send signals to the control module 32 representing the fluid pressure within the hydraulic cylinder 20. When the mining shovel 10 is in the static load condition (i.e. no input is received from the operator input device 22), the control module 32 monitors the fluid pressure within the cylinder 20. When the fluid pressure within an end 28 or 26 decreases below a first fluid pressure threshold (i.e. a predetermined fluid pressure level associated with cavitation of the cylinder 20), the control module 32 increases the amount of pressurized fluid routed to the corresponding end 28 or 26. When the fluid pressure increases above a second fluid pressure threshold (i.e. a fluid pressure that is a predetermined amount greater than the first fluid pressure level and within a range of fluid pressures not associated with cavitation of the cylinder 20), the control module 32 decreases the amount of pressurized fluid routed to the corresponding end 28 or 26.

Figure 2:
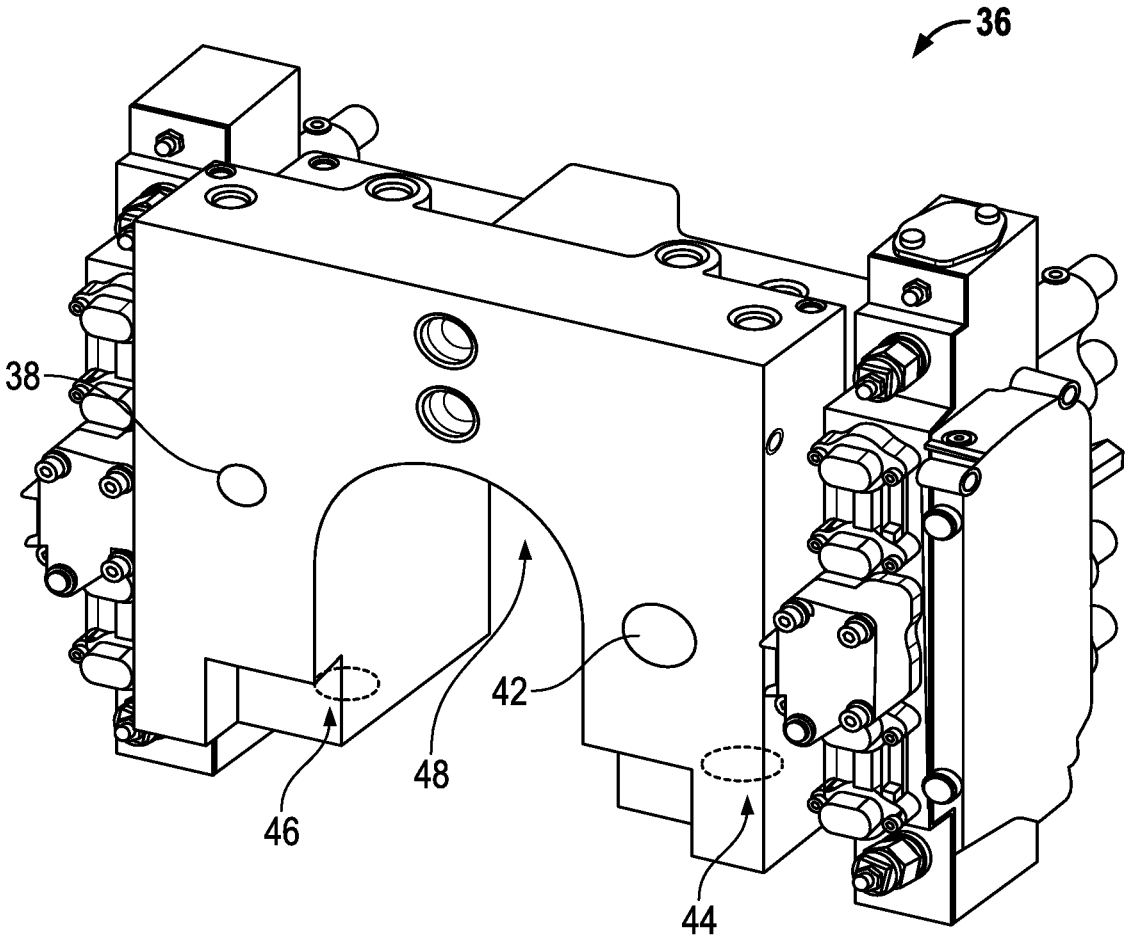
FIG. 2 is a perspective view of a control valve for a mining shovel, according to an exemplary embodiment.

Referring now to FIG. 2, a hydraulic valve system for the mining shovel 10 is shown, according to an exemplary embodiment. The void protection system 40 includes a hydraulic valve system or assembly, shown as an independent metering valve (IMV) assembly 36 in FIG. 2. The IMV assembly 36 is located at or near the top end of the boom assembly 16 (shown in FIG. 1) and fluidly coupled to the hydraulic cylinder 20. The IMV assembly 36 includes a series of valves and fluid passageways (e.g. IMV arrangements) that are shown more particularly in the schematic representations of FIGS. 3-8. The IMV assembly 36 is shown to include two distinct IMV arrangements 116 and 118 in FIGS. 3-8, but may include any number of IMV arrangements as is suitable for the particular application in other embodiments. As shown generally in FIGS. 3-8, the IMV assembly 36 is fluidly connected to the hydraulic cylinder 20 and to the hydraulic pump 30, and is configured to provide a fluid flow from the hydraulic pump 30 to the hydraulic cylinder 20. For instance, when the fluid pressure within the hydraulic cylinder 20 decreases below the first fluid pressure threshold, the control module 32 causes the IMV assembly 36 to increase the size of a fluid passageway (e.g. valve openings, etc.) from the hydraulic pump 30 to the corresponding end 26 or 28 of the hydraulic cylinder 20 (see FIG. 3). In this example, when the fluid pressure in the cylinder 20 increases above the second fluid pressure threshold, the control module 32 causes the IMV assembly 36 to decrease the size of the fluid passageways from the hydraulic pump 30 to the corresponding end 26 or 28 of the cylinder 20.

Referring further to FIG. 2, the IMV assembly 36 includes openings 38 and 42 for fluidly connecting the IMV assembly 36 to the rod end 26 and the head end 28 of the cylinder 20, respectively. The IMV assembly 36 also includes an opening 46 for fluidly connecting the IMV assembly 36 to the hydraulic pump 30, and an opening 44 for fluidly connecting the IMV assembly 36 to a hydraulic tank (not shown). In an exemplary embodiment, the IMV assembly 36 receives fluid from the hydraulic pump 30 through opening 46 and routes the fluid to the rod end 26 or the head end 28 of the cylinder 20 through one or more fluid paths, as necessary. The IMV assembly 36 may also receive return fluid from the hydraulic cylinder 20 and route the fluid back to the hydraulic tank for re-use. The IMV assembly 36 also includes one or more valves (shown schematically in further detail in FIGS. 3-8) for routing hydraulic fluid throughout the IMV assembly 36.

In the illustrated embodiment of FIG. 2, the IMV assembly 36 includes a curved recess 48 sized and shaped to couple the IMV assembly 36 to the hydraulic cylinder 20 (e.g. by fitting over a portion of the cylinder 20, etc.). As shown in FIG. 1, the IMV assembly 36 may be coupled to an end of the cylinder 20 and is configured to route fluid for powering the cylinder 20 in exemplary embodiments. However, it is not required that the IMV assembly 36 be mounted directly to the cylinder 20, and in other embodiments the IMV assembly 36 may be otherwise coupled to the mining shovel 10 such that the IMV assembly 36 is able to route fluid to the hydraulic cylinder 20.

Figure 3:
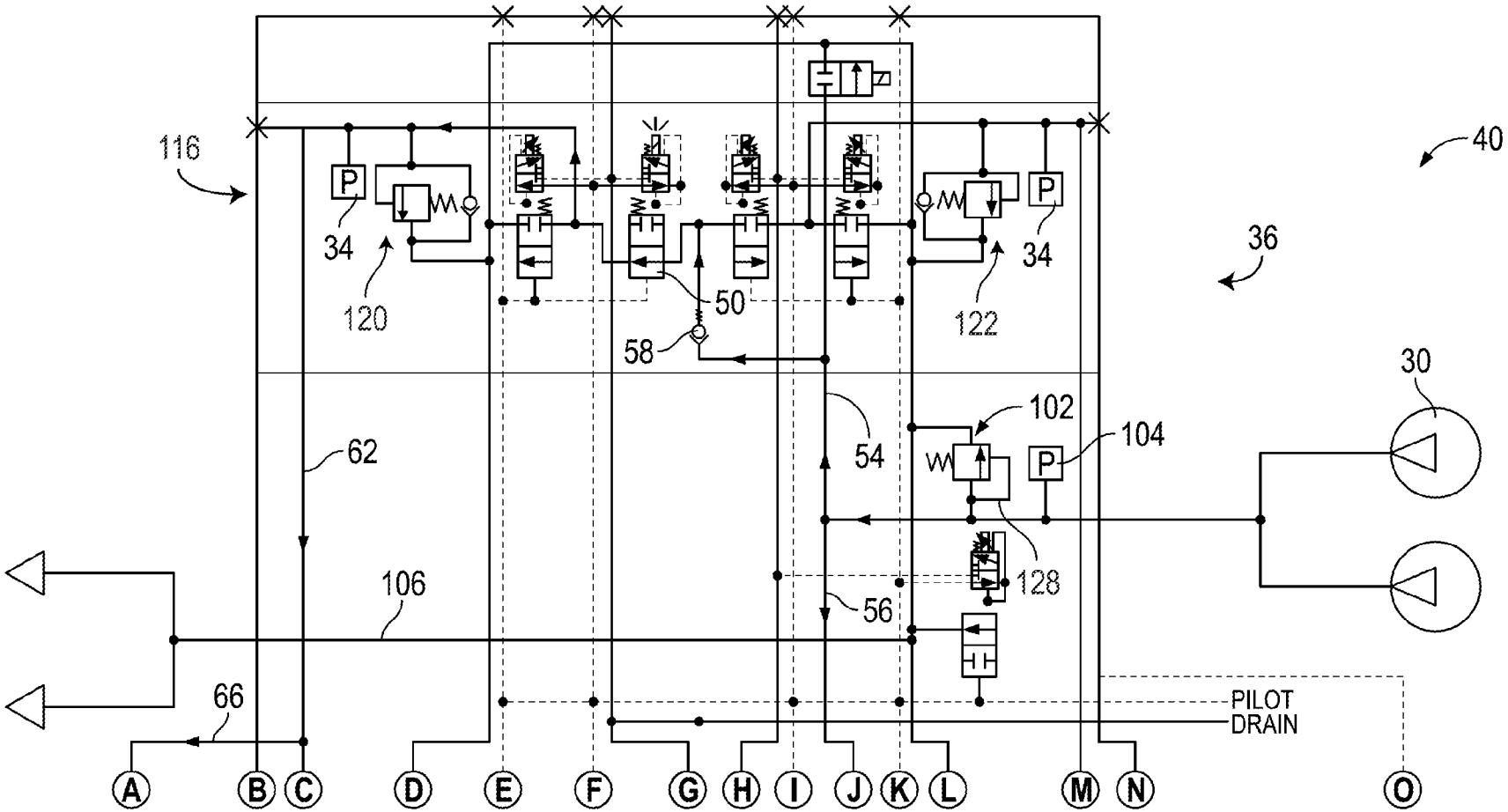
FIG. 3 is a schematic representation of a hydraulic system for a mining shovel, including a void protection system, according to an exemplary embodiment.
Figure 3:
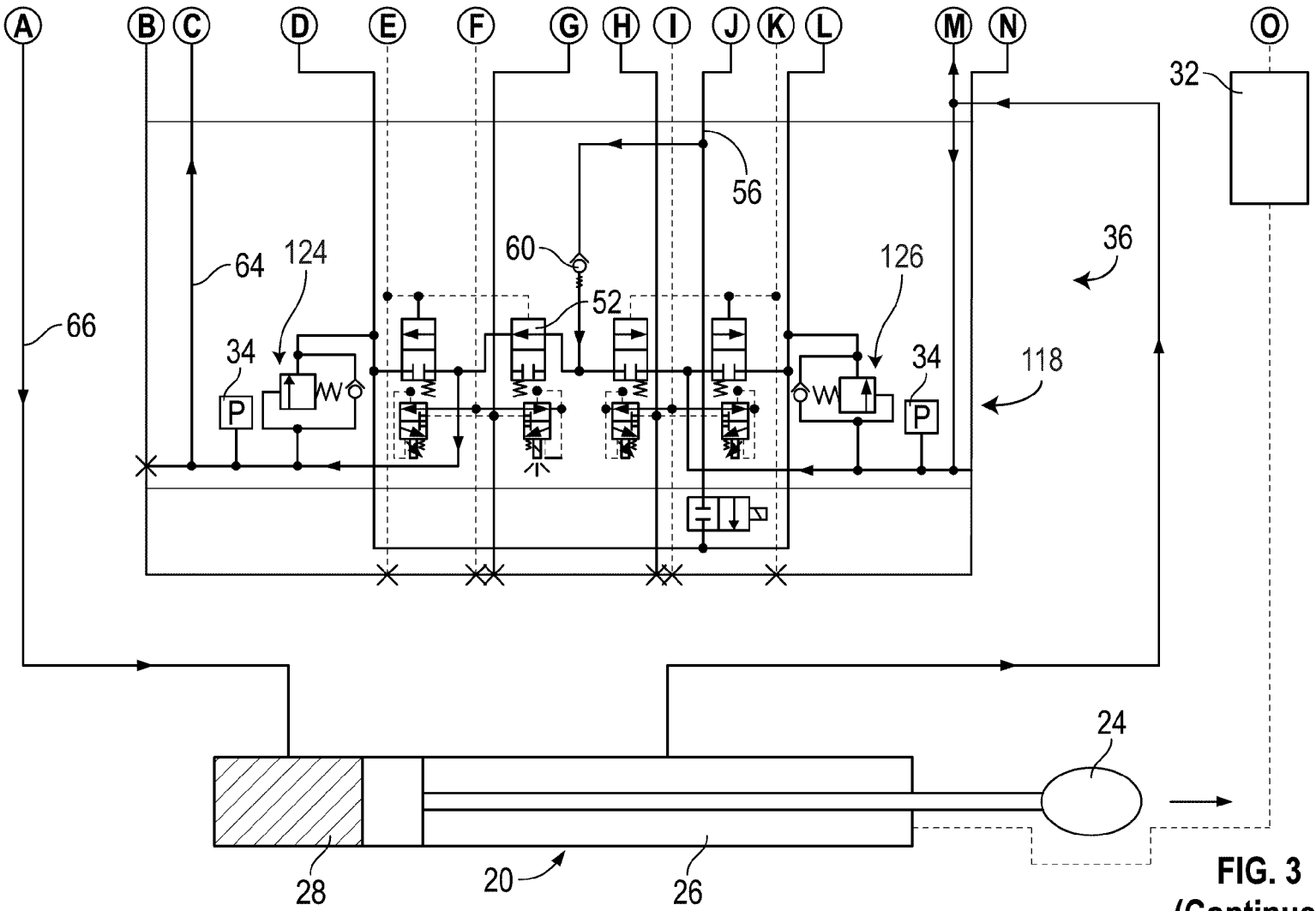

Referring now to FIGS. 3-8, schematics are shown for different states of the void protection system 40, including the IMV assembly 36, according to exemplary embodiments. Referring to FIG. 3, the actuator 24 of the hydraulic cylinder 20 is shown extended by the weight of the dipper 12, rather than in response to an input from the operator input device 22. As the actuator 24 is extended, the hydraulic fluid within the rod end 26 of the cylinder 20 is compressed and/or forced out of the cylinder 20 and back into the IMV assembly 36. The volume of the head end 28 of the cylinder 20 is increased, creating a void and decreasing the fluid pressure within the head end 28.

The IMV assembly 36 includes valves 50 and 52 fluidly connecting the hydraulic pump 30 to the head end 28 of the cylinder 20. When the fluid pressure in the head end 28 is below the first fluid pressure threshold, as measured by the sensors 34, the control module 32 may route pressurized hydraulic fluid from the pump 30 to the head end 28 by increasing the opening of the valves 50 and/or 52. In an exemplary embodiment, the control module 32 causes the valves 50 and 52 to open and close to varying degrees, allowing a larger or smaller amount of fluid to pass through the valves 50 and 52. In this embodiment, the valves 50 and 52 have an infinite number of open positions between the fully open (i.e. when the maximum amount of fluid passes through the valves 50 and 52) and fully closed (i.e. when no fluid or a minimal amount of fluid is allowed to pass through the valves 50 and 52) positions. In some other embodiments, however, the valves 50 and 52 are configured to move discretely between the fully open and the fully closed positions.

In the illustrated embodiment of FIG. 3, valves 50 and 52 are in an open position, allowing fluid from the hydraulic pump 30 to flow through the IMV assembly 36 to the head end 28 of the cylinder 20. The fluid flows from the pump 30 through fluid paths 54 and 56, and up to check valves 58 and 60, respectively. Once the fluid pressure builds to a predetermined level, the check valves 58 and 60 are pushed open and the fluid flows through the valves 50 and 52, through fluid paths 62 and 64, and meeting at fluid path 66 to fill the head end 28 with a sufficient amount of pressurized fluid to avoid cavitation. Once the fluid pressure within the head end 28 increases above a second fluid pressure threshold, indicating that a cavitation condition is no longer present, the control module 32 causes the opening of the valves 50 and 52 to be reduced, partially or fully blocking the fluid pathway from the pump 30 to the head end 28.

The IMV assembly 36 is also shown to include makeup valves 120 and 122 positioned within the IMV arrangement 116 and makeup valves 124 and 126 positioned within the IMV arrangement 118. In an exemplary embodiment, the makeup valves 120, 122, 124, and 126 may allow a relatively small amount of hydraulic fluid to flow through them and are intended to provide fluid to the head end 28 or rod end 26 when a void condition is present within the corresponding end 26 or 28. The fluid provided by the makeup valves 120, 122, 124, and 126 prevent cavitation within the cylinder 20 until fluid from another source (e.g. the pump 30, accumulator 86, end 26 or 28, etc.) is routed to the cylinder 20. For instance, when a void condition is present within the head end 28 of the cylinder 20, the control module 32 may cause the makeup valve 120 to route fluid through fluid paths 62 and 66 to the head end 28 of the cylinder 20, preventing cavitation within the head end 28 of the cylinder 20. The makeup valves 120, 122, 124, and 126 are shown in the FIG. 3 according to an exemplary embodiment, but in other embodiments the void protection system 40 may include any number of makeup valves positioned within the IMV assembly 36 and/or the void protection system 40 to prevent a void condition within the cylinder 20.

Figure 4:
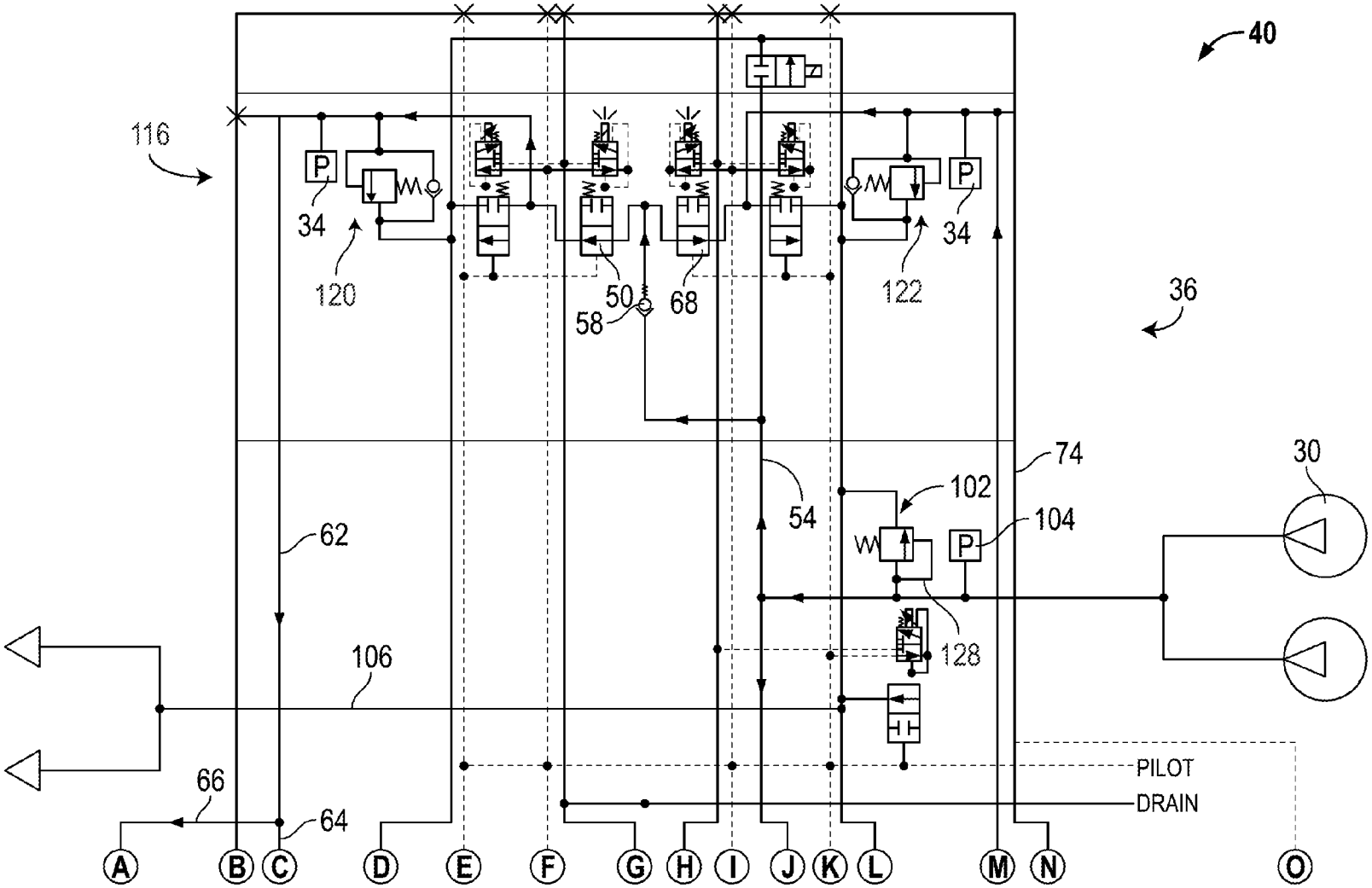
FIG. 4 is a schematic representation of another embodiment of the hydraulic system of FIG. 2, including a void protection system having a pump regeneration flow.
Figure 4:
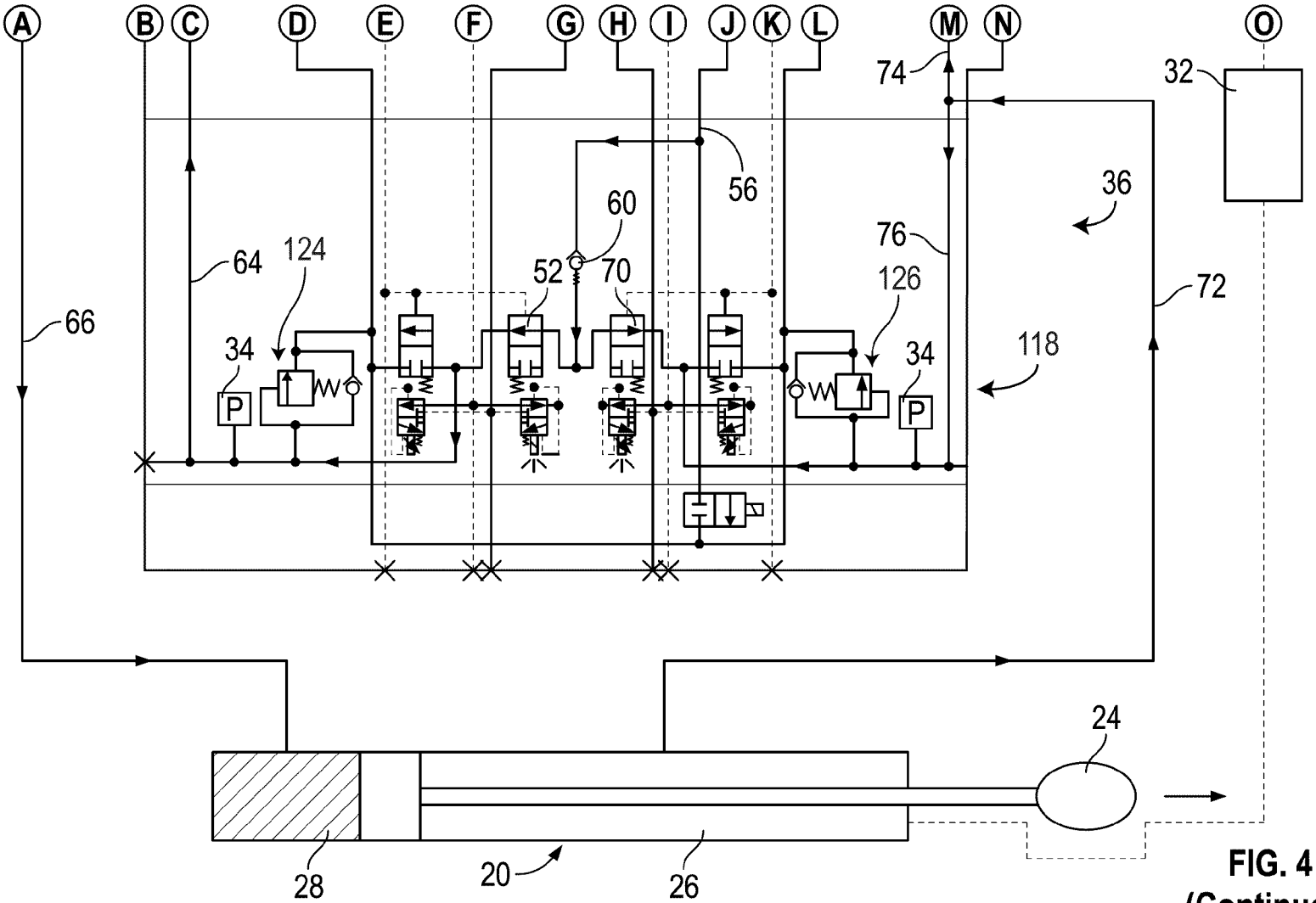

Referring now to FIG. 4, a schematic for the IMV assembly 36 is shown according to an alternative embodiment of the void protection system 40. The actuator 24 of the hydraulic cylinder 20 is shown extended by the weight of the dipper 12, rather than in response to an input from the operator input device 22. As the actuator 24 is extended, the volume of the head end 28 of the cylinder 20 is increased, creating a void and decreasing the fluid pressure within the head end 28. As in the embodiment of FIG. 3, the control module 32 causes the valves 50 and 52 to open, routing hydraulic fluid from the pump 30 to the head end 28 of the cylinder 20 to fill the void within the head end 28.

In the illustrated embodiment of FIG. 4, the fluid provided by the pump 30 to the cylinder 20 may not be sufficient to prevent cavitation within the head end 28. Therefore, the control module 32 also causes valves 68 and 70 to open, metering the flow out of the rod end 26 of the cylinder 20. In an exemplary embodiment, the control module 32 causes the valves 68 and 70 to open and close to varying degrees, allowing a larger or smaller amount of fluid to pass through the valves 68 and 70. In this embodiment, the valves 68 and 70 have an infinite number of open positions between the fully open (i.e. when the maximum amount of fluid passes through the valves 68 and 70) and fully closed (i.e. when no fluid or a minimal amount of fluid is allowed to pass through the valves 68 and 70) positions. In some other embodiments, however, the valves 68 and 70 are configured to move discretely between the fully open and the fully closed positions.

Referring again to FIG. 4, when the actuator 24 is extended, the hydraulic fluid within the rod end 26 is compressed and forced out of the cylinder 20, back into the IMV assembly 36. The fluid is pushed from the rod end 26 of the cylinder 20 through fluid paths 72, 74, and 76, and through the open valves 68 and 70. The fluid is allowed to flow through open valves 50 and 52 and fluid paths 62, 64 and 66, then to the head end 28 of the cylinder 20, supplementing the fluid from the pump 30 in order to prevent cavitation within the head end 28 of the cylinder 20. The fluid routed from the rod end 26 may be intended to reduce the burden on the pump 30 until the pump 30 can respond to provide the required fluid flow. The control module 32 causes valves 68 and 70, as well as valves 52 and 50, to remain open until the fluid pressure within the head end 28 increases above the second fluid pressure threshold.

Figure 5:
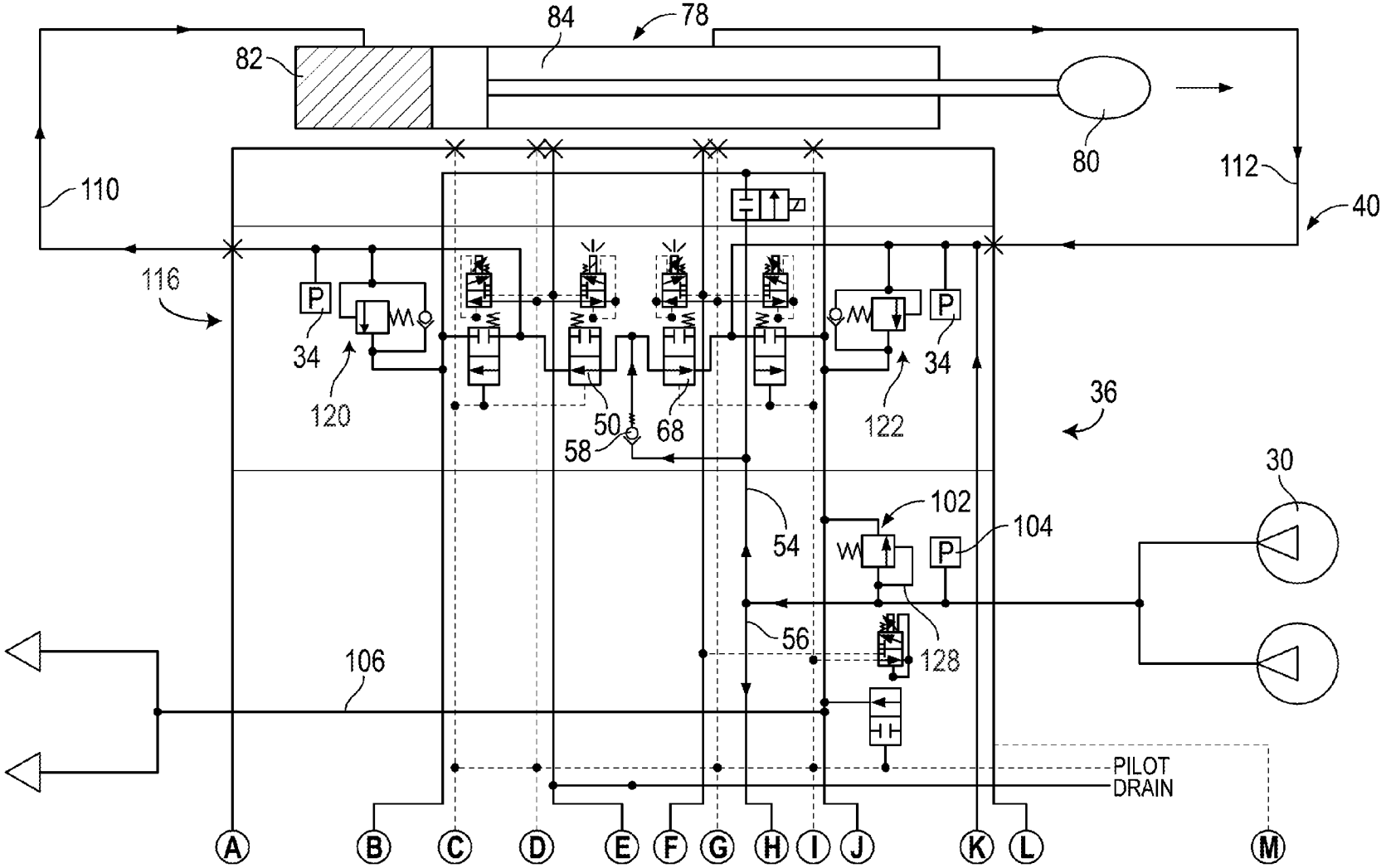
FIG. 5 is a schematic representation of another embodiment of the hydraulic system of FIG. 2, including a void protection system having a second hydraulic cylinder.
Figure 5:
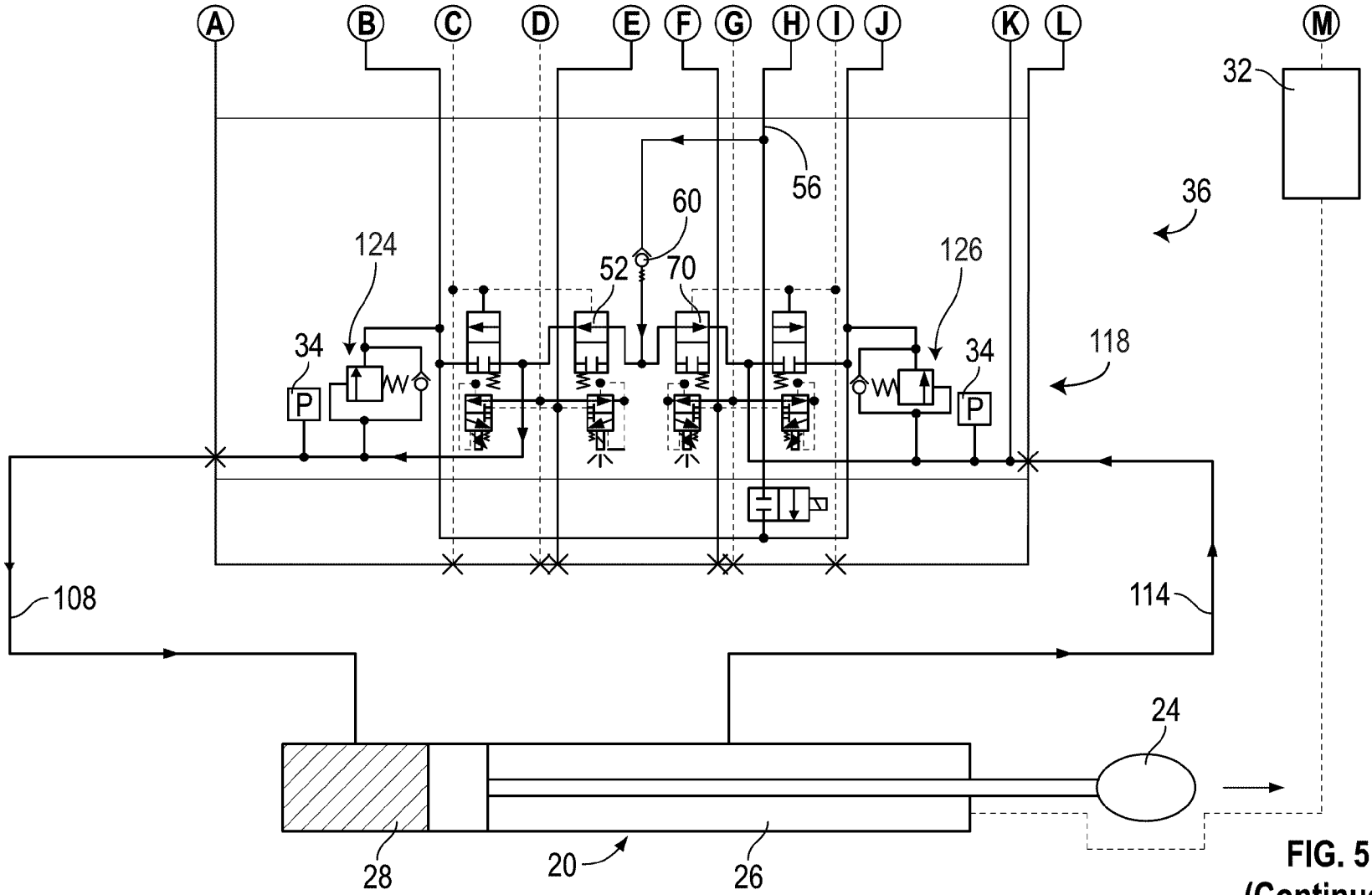

Referring now to FIG. 5, a schematic for the IMV assembly 36 and void protection system 40 is shown, according to an alternative embodiment. In this embodiment, the mining shovel 10 includes two hydraulic cylinders 20 and 78. The hydraulic cylinders 20 and 78 are shown fluidly connected to the IMV assembly 36. However, in other embodiments having two hydraulic cylinders 20 and 78, the mining shovel 10 may include a second hydraulic valve system fluidly connected to the hydraulic cylinder 78, in addition to the IMV assembly 36 fluidly connected to the hydraulic cylinder 20. The hydraulic cylinder 78 includes an actuator 80, a head end 82, and a rod end 84.

According to the illustrated embodiment of FIG. 5, the actuators 24 and 80 are shown extended by the weight of the dipper 12, rather than in response to an input from the operator input device 22. As the actuators 24 and 80 are extended, the volumes of the head ends 28 and 82 are increased, creating a void and decreasing the fluid pressure within the head ends 28 and 82. In this embodiment, the control module 32 causes the valves 50 and 52 to open, allowing pressurized fluid to flow from the pump 30 to the head ends 82 and 28, respectively, in order to prevent cavitation. However, in this embodiment the fluid provided by the pump 30 may not be sufficient to prevent cavitation within the head ends 28 and 82. Therefore, the control module 32 also causes valves 68 and 70 to open. When the actuators 24 and 80 are extended, the hydraulic fluid within the rod ends 26 and 84 is compressed and forced out of the hydraulic cylinders 20 and 78, respectively, and back into the IMV assembly 36. Fluid flows from the rod end 84 through fluid path 112, through open valves 68 and 50, and through fluid path 110 to the head end 82 to prevent cavitation. Fluid also flows from the rod end 26 through fluid path 114, through open valves 70 and 52, and through fluid path 108 to the head end 28 to prevent cavitation. The valves 68 and 70 are opened by the control module 32 in order to supplement the fluid from the pump 30 and reduce the burden on the pump 30 that results from the second cylinder 78. In some embodiments having multiple cylinders, all cylinders are fluidly connected to a single hydraulic valve system (e.g. IMV assembly 36, etc.), such as in the embodiment of FIG. 5. In other embodiments, the mining shovel 10 may include a single cylinder fluidly connected to more than one hydraulic valve system.

Figure 6:
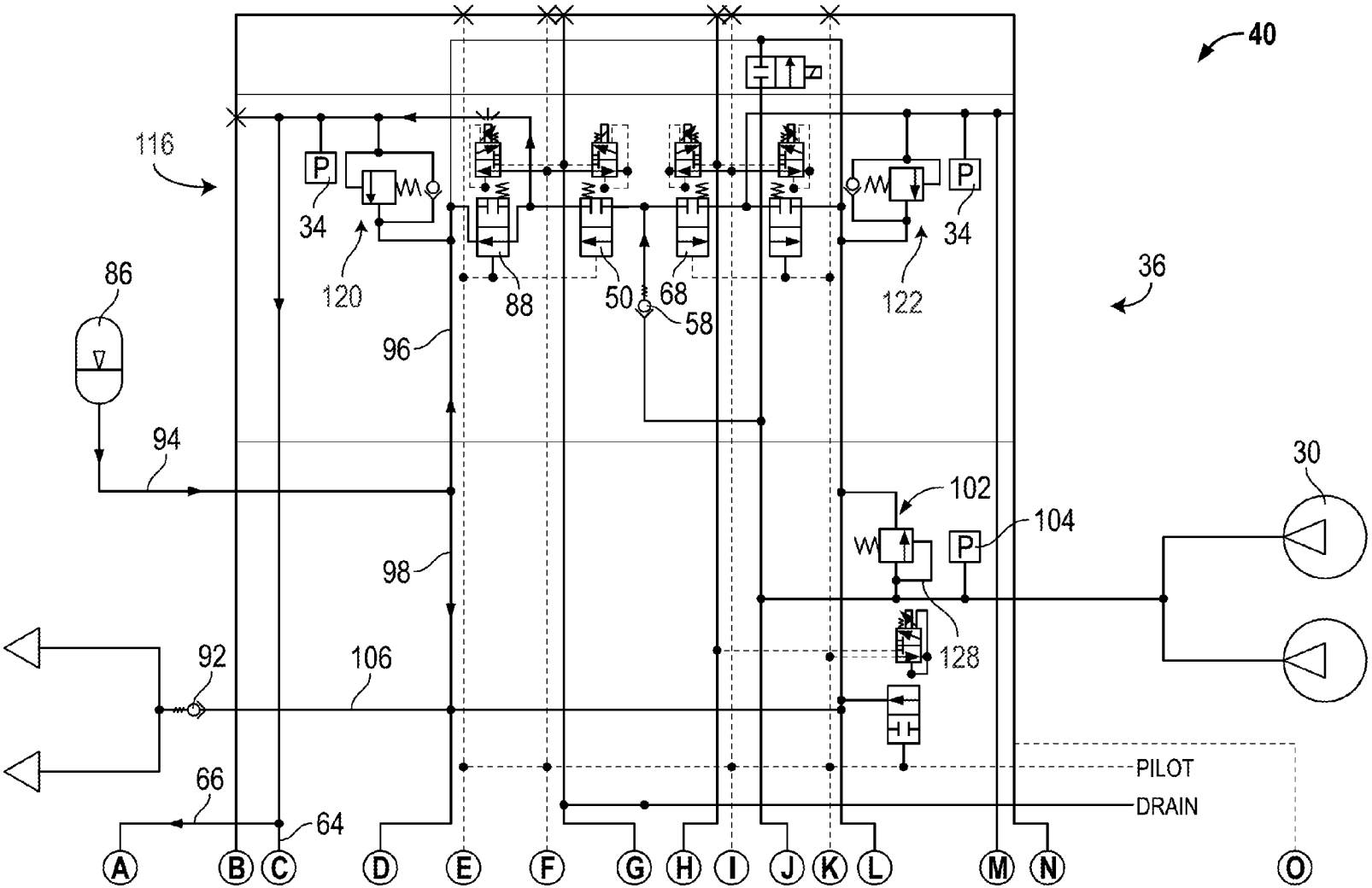
FIG. 6 is a schematic representation of another embodiment of the hydraulic system of FIG. 2, including a void protection system having a make-up accumulator.
Figure 6:
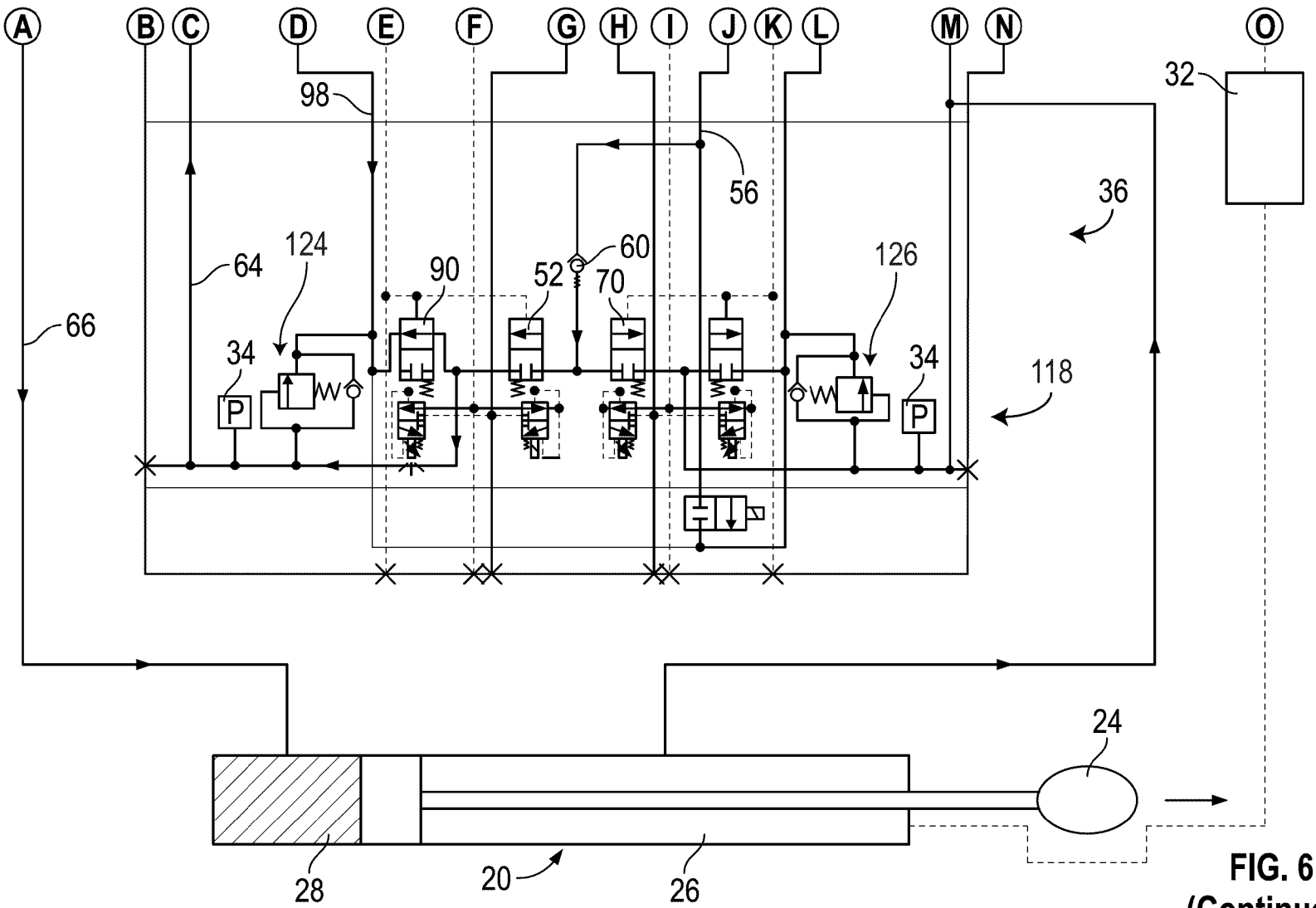

Referring now to FIG. 6, a schematic for the IMV assembly 36 is shown, according to an exemplary embodiment. In this embodiment, the void protection system 40 includes an accumulator 86 fluidly connected to the IMV assembly 36. The actuator 24 of the hydraulic cylinder 20 is shown extended by the weight of the dipper 12, rather than in response to an input from the operator input device 22. As the actuator 24 is extended, the volume of the head end 28 of the cylinder 20 is increased, creating a void and decreasing the fluid pressure within the head end 28. In this embodiment, the fluid provided by the pump 30 may not be sufficient to prevent cavitation within the head end 28 of the cylinder 20. The accumulator 86 therefore provides another source of fluid for filling the cylinder 20 in order to prevent cavitation.

In the illustrated embodiment of FIG. 6, the control module 32 causes valves 88 and 90 to open when the fluid pressure within the head end 28 of the hydraulic cylinder 20 decreases below a first fluid pressure threshold, allowing fluid to flow through the valves 88 and 90. In an exemplary embodiment, the control module 32 causes the valves 88 and 90 to open and close to varying degrees, allowing a larger or smaller amount of fluid to pass through the valves 88 and 90. In this embodiment, the valves 88 and 90 have an infinite number of open positions between the fully open (i.e. when the maximum amount of fluid passes through the valves 88 and 90) and fully closed (i.e. when no fluid or a minimal amount of fluid is allowed to pass through the valves 88 and 90) positions. In some other embodiments, however, the valves 88 and 90 are configured to move discretely between the fully open and the fully closed positions.

Referring again to FIG. 6, the control module 32 causes the accumulator 86 to send fluid into fluid path 94, through fluid path 96 and/or 98, and through the valve 88 and/or 90. The fluid flows from open valves 88 and 90 through fluid paths 62 and 64, respectively, through fluid path 66, and into the head end 28 to prevent cavitation. In this embodiment, the IMV assembly 36 may include a check valve 92 to prevent fluid from the accumulator 86 from returning to the hydraulic tank (not shown). Fluid from the accumulator 86 must build to a predetermined pressure in order to pass through the check valve 92 to the tank, maintaining a pressure within fluid paths 62 and 64 in order to fill a void in the head end 28 of the cylinder 20.

Figure 7:
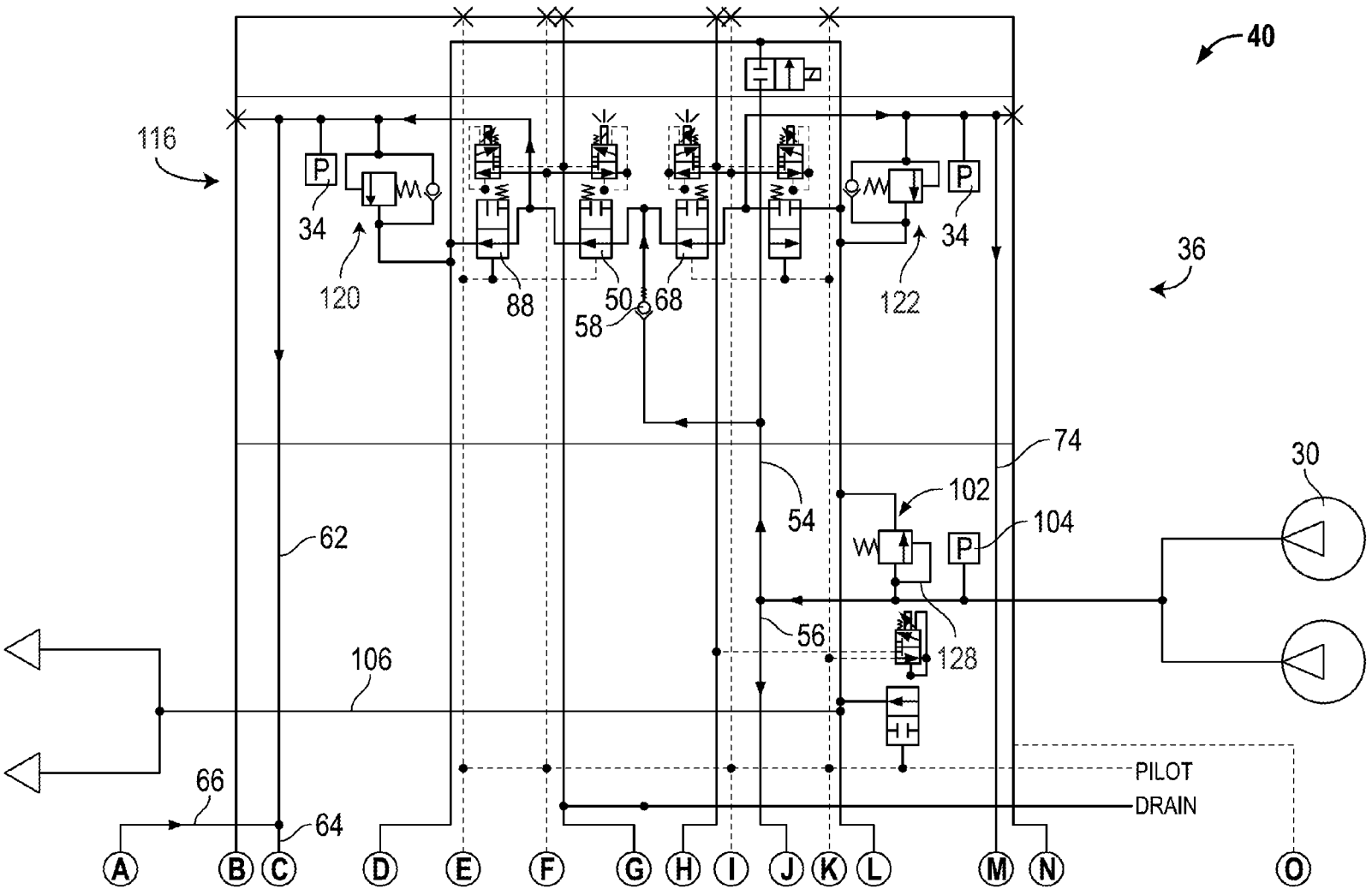
FIG. 7 is a schematic representation of another embodiment of the hydraulic system of FIG. 2, including a void protection system for filling the rod end of a cylinder.
Figure 7:
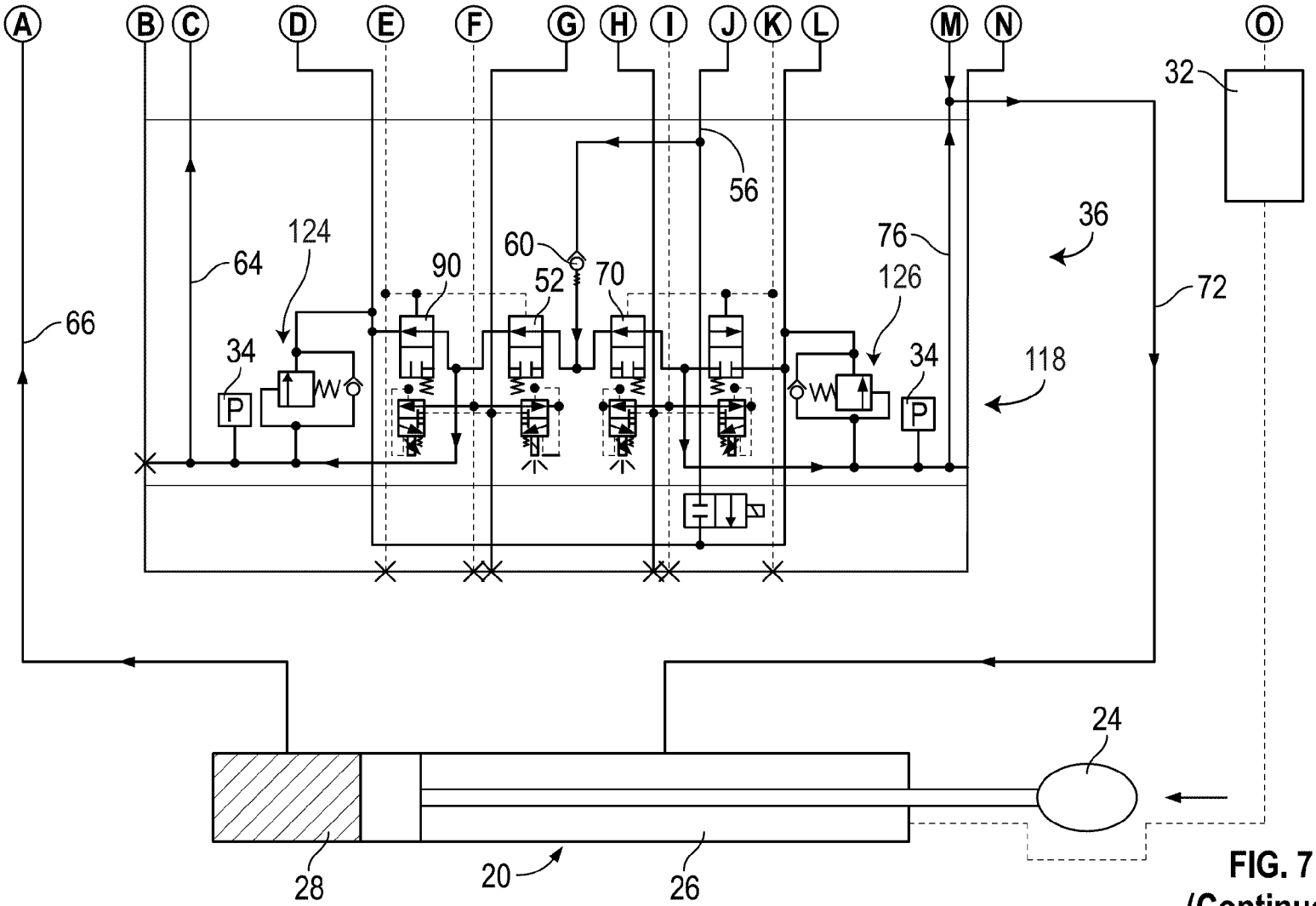

Referring now to FIG. 7, a schematic for the IMV assembly 36 is shown, according to an alternative embodiment. In this embodiment, the actuator 24 of the hydraulic cylinder 20 is shown retracted by the weight of the dipper 12. As the actuator 24 is retracted, the hydraulic fluid within the head end 28 of the cylinder 20 is compressed and forced out of the cylinder 20, back into the IMV assembly 36. The volume of the rod end 26 of the cylinder 20 is increased, creating a void and decreasing the fluid pressure within the rod end 26. When the fluid pressure in the rod end 26 is below the first fluid pressure threshold, as measured by the sensors 34, the control module 32 may cause the openings of the valves 50, 52, 68, and 70 to increase. When the actuator 24 is retracted, fluid is pushed from the head end 28 of the cylinder 20 through fluid paths 66, 62, and 64, and through the open valves 50 and 52. The fluid is allowed to flow through open valves 68 and 70 and fluid paths 74, 76, and 72, then to the rod end 26 of the cylinder 20. The fluid from the head end 28 is used to prevent cavitation within the rod end 26 of the cylinder 20. The control module 32 may cause valves 50 and 52 to remain open until the fluid pressure within the rod end 26 increases above the second fluid pressure threshold.

Still referring to the illustrated embodiment of FIG. 7, the control module 32 may also route pressurized hydraulic fluid from the pump 30 to the rod end 26 by increasing the opening of the valves 68 and/or 70. In the illustrated embodiment of FIG. 7, valves 68 and 70 are open, allowing fluid from the hydraulic pump 30 to flow through the IMV assembly 36 to the rod end 26 of the cylinder 20. The fluid flows from the pump 30 through fluid paths 54 and 56, and up to check valves 58 and 60, respectively. Once the fluid pressure builds to a predetermined level, the check valves 58 and 60 are pushed open and the fluid flows through the valves 68 and 70, through fluid paths 74 and 76, and meeting at fluid path 72 to fill the rod end 26 with a sufficient amount of pressurized fluid to avoid cavitation. Once the fluid pressure within the rod end 26 increases above a second fluid pressure threshold, indicating that a cavitation condition is no longer present, the control module 32 causes the valves 68 and 70 to close, blocking the fluid pathway from the pump 30 to the rod end 26. The fluid from the pump 30 is intended to supplement the fluid from the head end 28 of the cylinder 30. In some embodiments, the fluid routed from the head end 28 may be intended to prevent cavitation within the rod end 26 until fluid from the pump 30 reaches the rod end 26.

According to the illustrated embodiment of FIG. 7, the control module 32 may also cause valves 88 and 90 to open. In this embodiment, fluid in excess of the amount necessary to prevent cavitation within the rod end 26 may be routed from the head end 28 into the IMV assembly 36. This excess fluid may be routed from the head end 28 through open valves 88 and/or 90. The fluid is then routed through fluid paths 62 and/or 64, through fluid path 106, and outside of the IMV assembly 36 to a hydraulic tank (not shown) for re-use.

Figure 8:
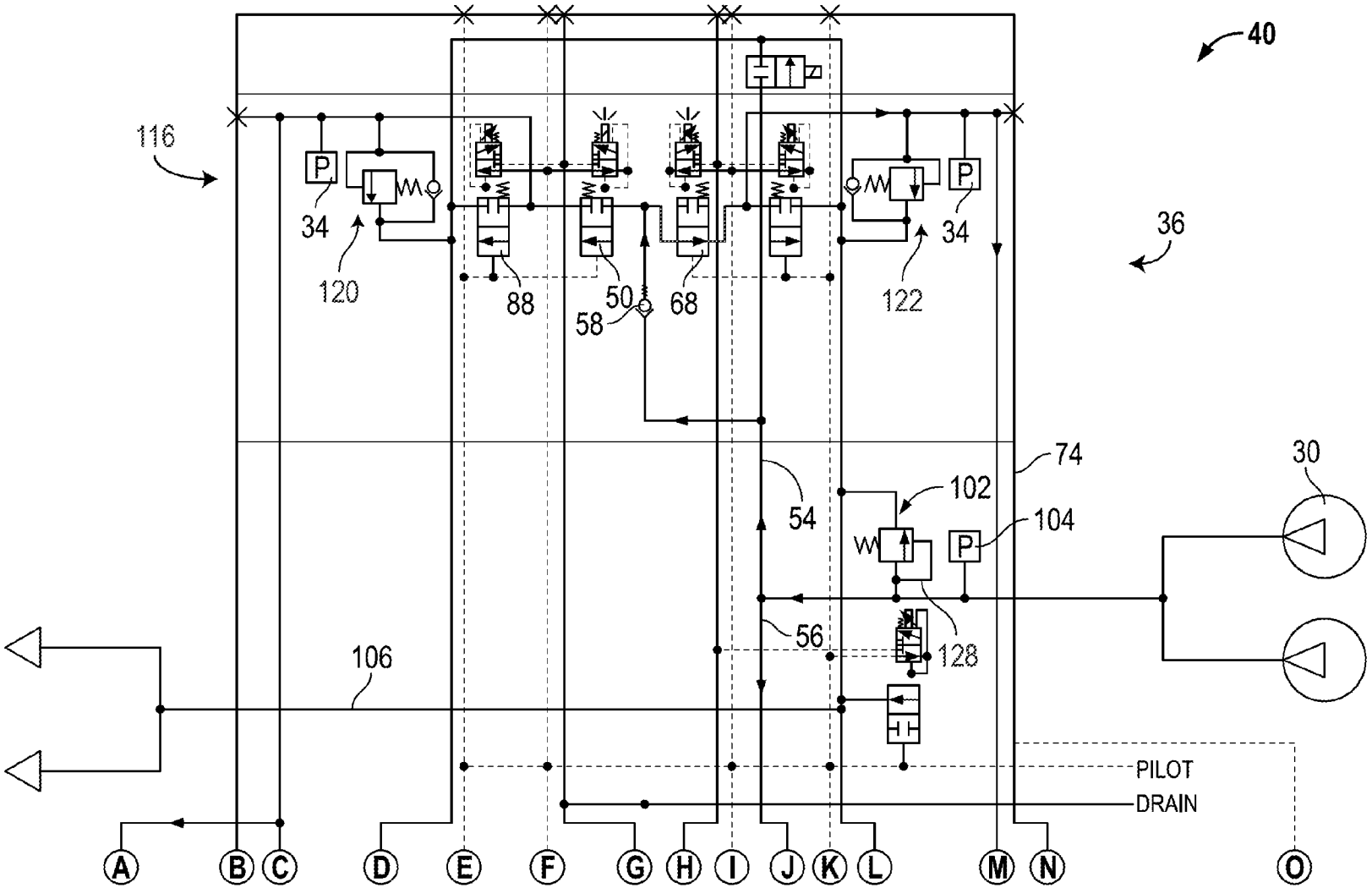
FIG. 8 is a schematic representation of another embodiment of the hydraulic system of FIG. 2, including a void protection system for compressing fluid at the rod end of a cylinder.
Figure 8:
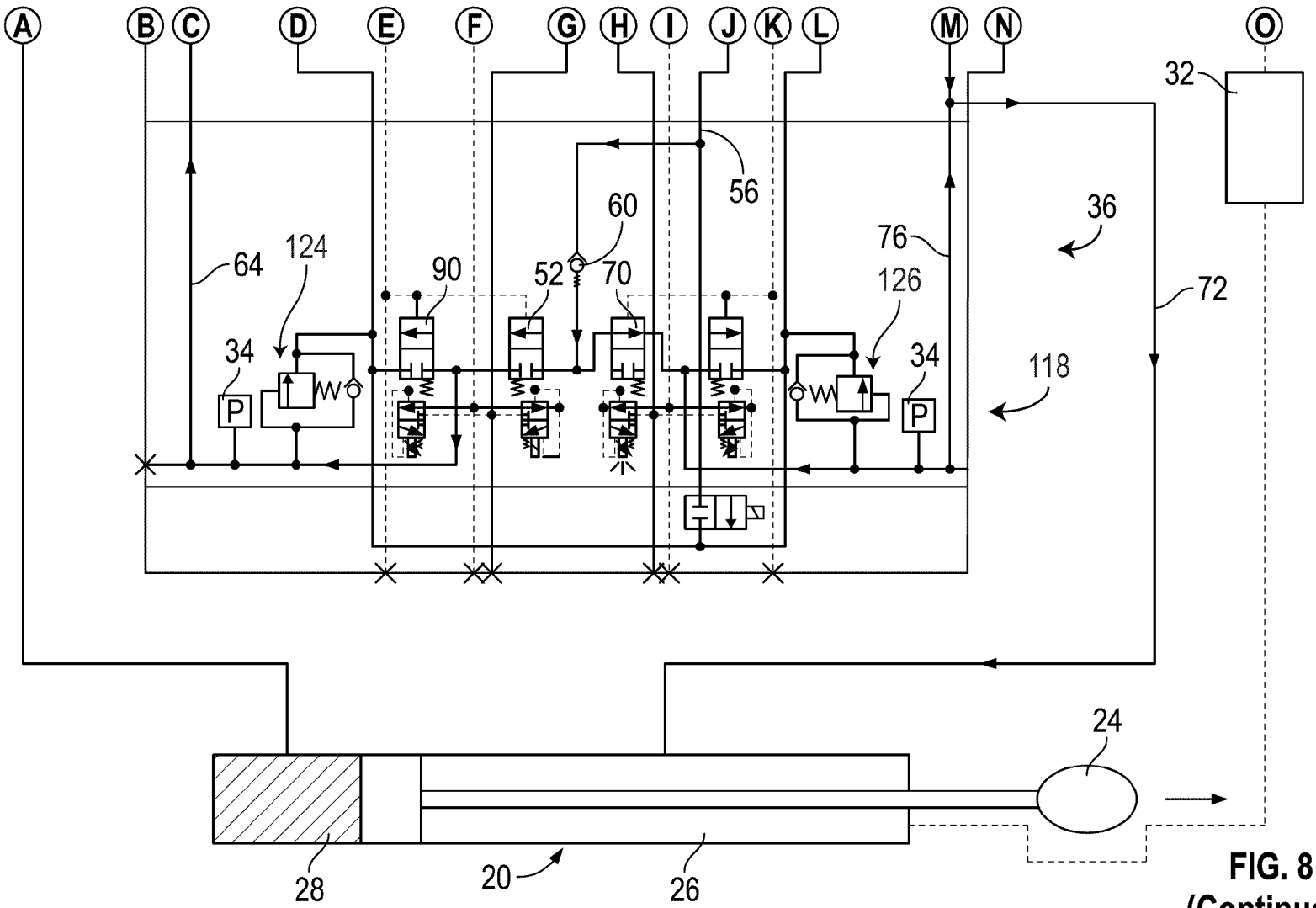

Referring now to FIG. 8, another embodiment of the IMV assembly 36 and the void protection system 40 is shown. In this embodiment, the actuator 24 of the hydraulic cylinder 20 is shown extended by the weight of the dipper 12, creating a void at the head end 28 of the cylinder 20. In response to the void condition (i.e. the fluid pressure is below the first fluid pressure threshold), the control module 32 may cause valves 68 and 70 to open, and valves 50 and 52 to remain closed. When valves 68 and 70 are opened, fluid from the pump 30 flows through fluid paths 54 and 56, through check valves 58 and 60, and through the open valves 68 and 70. The fluid is routed by the IMV assembly 36 through fluid paths 74, 76, and 72 to the rod end 26 of the cylinder 20. The fluid from the pump 30 compresses the fluid in the rod end 26 of the cylinder 20, raising the fluid pressure within the rod end 26. As the fluid pressure in the rod end 26 is raised, the refraction of the actuator 24 is reduced, preventing cavitation within the head end 28.

Referring again to FIGS. 3-8, the IMV assembly 36 may include a relief valve 102. The control module 32 may cause the relief valve 102 to open when pressure within the IMV assembly 36 reaches a third fluid pressure threshold (i.e. fluid pressure at which the IMV assembly 36 or its components are at risk for damage). When the relief valve 102 opens, fluid passes through the valve 102, through pump bypass line 128, and through fluid path 106 to the hydraulic tank for re-use. The pump bypass line 128 diverts fluid to the tank to circulate oil and prevent a high standby pressure within the system 40. The fluid pressure within the system 40 is measured by a pressure sensor 104 located near the hydraulic pump 30.

It should be noted that the valves (e.g. valves 50, 52, 68, 70, 88, 90, etc.) that are shown in the FIGURES and described above may be any types of valves configured to route fluid throughout the void protection system 40. For instance, the valves may be spool valves, poppet valves, servo valves, or the like.

The construction and arrangements of the void protection system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Industrial Applicability

The disclosed void protection system may be implemented into any hydraulic vehicle or device having a hydraulic actuator forced to extend or retract due to gravity. The disclosed void protection system may reduce damage to the hydraulic system and the vehicle components by reducing cavitation within the hydraulic system. The void protection system may increase the life of the hydraulic components by preventing damage to the components due to cavitation, and may decrease the response time to a cavitation condition by automatically creating a response when a void condition occurs within the system. The disclosed void protection system may also reduce unwanted noise and vibrations within the vehicle and increase the vehicle's efficiency.

It will be apparent to those skilled in the art that various modifications and variations can be made to the disclosed void protection system. Other embodiments will be apparent to those skilled in the art from consideration of the specification and practice of the disclosed void protection system. It is intended that the specification and examples be considered as exemplary only, with a true scope being indicated by the following claims and their equivalents.

What is claimed is:

1. A mining shovel, comprising:

a boom assembly;

a hydraulic cylinder having a rod end and a head end;

a dipper coupled to the boom assembly such that movement of the hydraulic cylinder moves the dipper;

an independent metering valve assembly coupled to the hydraulic cylinder and to a fluid source, the assembly comprising:

one or more fluid source-cylinder valves each having an opening for fluidly connecting the fluid source to the hydraulic cylinder;

an operator input device;

a sensor assembly for monitoring the fluid pressure within the rod end and the head end of the hydraulic cylinder;

a control module configured to monitor movement of the operator input device and control the hydraulic cylinder based on the movement of the operator input device, and, when there is no movement at the operator input device, to:

monitor pressure within the head end and the rod end of the hydraulic cylinder by receiving signals from the sensor assembly;

when the signals indicate that the pressure in the rod end or the head end of the hydraulic cylinder is below a first threshold pressure, increase the opening of the corresponding fluid source-cylinder valve and increase fluid flow from the fluid source to fill the corresponding end of the hydraulic cylinder until the pressure in the corresponding end is above a second threshold pressure; and when the signals indicate that the pressure in the rod end or the head end of the hydraulic cylinder is greater than the second threshold pressure, reduce the opening of the corresponding fluid source-cylinder valve and decrease fluid flow from the fluid source.

2. The mining shovel of claim 1, wherein the independent metering valve assembly further comprises:

a head end-rod end valve for fluidly connecting the head end to the rod end;

wherein the control module is configured to:

when pressure in the head end of the hydraulic cylinder decreases below the first threshold pressure, increase the opening of the head end-rod end valve and route fluid from the rod end to fill the head end until pressure in the head end is above the second threshold pressure; and when pressure in the rod end of the hydraulic cylinder decreases below the first threshold pressure, increase the opening of the head end-rod end valve and route fluid from the head end to fill the rod end until pressure in the rod end is above the second threshold pressure.

3. The mining shovel of claim 2, wherein the control module is configured to:

when pressure in the head end and the rod end of the hydraulic cylinder increases beyond the second threshold pressure, reduce opening of the head end-rod end valve.

4. The mining shovel of claim 1, further comprising:

a second hydraulic cylinder having a second rod end and a second head end;

wherein the pressure sensor assembly monitors the fluid pressure within the second rod end and the second head end;

wherein the independent metering valve assembly is coupled to the second hydraulic cylinder and further comprises a fluid source-second cylinder valve for fluidly connecting the fluid source to the second hydraulic cylinder;

wherein the control module is configured to:

when there is no movement at the operator input device, monitor pressure within the second head end and the second rod end by receiving signals from the sensor assembly;

when pressure in the second rod end or the second head end decreases below a third threshold pressure, increase opening of the corresponding fluid source-second cylinder valve and increase fluid flow from the fluid source to fill the corresponding end of the second hydraulic cylinder until pressure in the corresponding end is above a fourth threshold pressure; and when pressure in the second rod end or the second head end increases beyond the fourth threshold pressure, reduce opening of corresponding fluid source-second cylinder valve and decrease fluid flow from the fluid source.

5. The mining shovel of claim 4, wherein the independent metering valve assembly further comprises:

a second head end-second rod end valve for fluidly connecting the second head end to the second rod end;

wherein the control module is configured to:

when pressure in the second head end decreases below the third threshold pressure, increase the opening of the second head end-second rod end valve and route fluid from the second rod end to fill the second head end until pressure in the second head end is above the fourth threshold pressure; and when pressure in the second rod end of the hydraulic cylinder decreases below the third threshold pressure, increase the opening of the second head end-second rod end valve and route fluid from the second head end to fill the second rod end until pressure in the second rod end is above the fourth threshold pressure.

6. The mining shovel of claim 1, further comprising:

an accumulator fluidly coupled to the independent metering valve assembly;

wherein the control module is configured:

when pressure in the rod end or the head end of the hydraulic cylinder decreases below a first threshold pressure, route fluid from the accumulator to fill the corresponding end of the hydraulic cylinder until pressure in the corresponding end is above the second threshold pressure; and when pressure in the rod end or the head end of the hydraulic cylinder increases beyond the second threshold pressure, decrease fluid flow from the accumulator.

7. The mining shovel of claim 6, wherein the independent metering valve assembly further comprises:

an accumulator-cylinder valve for fluidly connecting the accumulator to the hydraulic cylinder;

wherein the control module is configured to:

when pressure in the rod end or the head end of the hydraulic cylinder decreases below a first threshold pressure, increase opening of the corresponding accumulator-cylinder valve to fill the corresponding end of the hydraulic cylinder until pressure in the corresponding end is above a second threshold pressure; and when pressure in the rod end or the head end of the hydraulic cylinder increases beyond the second threshold pressure, reduce opening of corresponding accumulator-cylinder valve.

8. The mining shovel of claim 6, wherein the independent metering valve assembly further comprises:

a check valve fluidly coupled to the accumulator;

wherein the check valve is configured to prevent fluid having a fluid pressure below a predetermined level from flowing outside of the independent metering valve assembly.

9. The mining shovel of claim 1, wherein the control module is configured to:

when pressure in the rod end of the hydraulic cylinder decreases below a first threshold pressure, increase opening of a fluid source-head end valve and increase fluid flow from the fluid source to fill the head end of the hydraulic cylinder until pressure in the rod end is above a second threshold pressure;

when pressure in the head end of the hydraulic cylinder decreases below a first threshold pressure, increase opening of a fluid source-rod end valve and increase fluid flow from the fluid source to fill the rod end of the hydraulic cylinder until pressure in the head end is above a second threshold pressure;

when pressure in the rod end of the hydraulic cylinder increases beyond the second threshold pressure, reduce opening of the fluid source-head end valve and decrease fluid flow from the fluid source; and when pressure in the head end of the hydraulic cylinder increases beyond the second threshold pressure, reduce opening of the fluid source-rod end valve and decrease fluid flow from the fluid source.

10. The mining shovel of claim 1, wherein the independent metering valve assembly comprises more than one independent metering valve arrangement for routing fluid to the hydraulic cylinder.

11. The mining shovel of claim 1, wherein the independent metering valve assembly comprises:

a relief valve coupled to the fluid source; and a relief pressure sensor for measuring the fluid pressure at the relief valve;

wherein the control module is configured to cause the relief valve to release fluid from the independent metering valve assembly when the fluid pressure at the relief valve reaches a predetermined pressure.

12. The mining shovel of claim 1, wherein the independent metering valve assembly comprises:

a first fluid path for fluidly connecting the fluid source to the rod end of the hydraulic cylinder; and a second fluid path for fluidly connecting the fluid source to the head end of the hydraulic cylinder;

wherein the fluid source-cylinder valves comprise:

a first valve coupled to the first fluid path and configured to controllably block the first fluid path; and a second valve coupled to the second fluid path and configured to controllably block the second fluid path.

13. The mining shovel of claim 1, wherein the sensor assembly comprises:

one or more sensors configured to measure the displacement of the hydraulic cylinder;

wherein the sensor assembly is configured to monitor the fluid pressure within the rod end and the head end of the hydraulic cylinder by measuring the displacement of the hydraulic cylinder.

14. The mining shovel of claim 1, wherein the sensor assembly comprises:

one or more sensors configured to measure the velocity of the hydraulic cylinder;

wherein the sensor assembly is configured to monitor the fluid pressure within the rod end and the head end of the hydraulic cylinder by measuring the velocity of the hydraulic cylinder.

* * * * *